United States Patent [19]

Luna

[11] 4,168,873

[45] Sep. 25, 1979

[54] WIRE CONNECTIONS TO BOARD TERMINALS

[76] Inventor: L. Jack Luna, 1868 N. Calle Salto, Thousand Oaks, Calif. 91360

[21] Appl. No.: 892,883

[22] Filed: Apr. 3, 1978

[51] Int. Cl.[2] ..... H01R 9/08

[52] U.S. Cl. ..... 339/97 R; 339/108 TP; 339/255 R

[58] Field of Search ..... 339/97, 98, 99 R, 108 TP, 339/276 R, 276 T, 255 R

[56] References Cited

U.S. PATENT DOCUMENTS

| | | | |
|---|---|---|---|
| 2,651,768 | 9/1953 | Oortgijsen | 339/97 R |
| 3,071,750 | 1/1963 | Heselwood | 339/97 R |
| 3,145,261 | 8/1964 | Forney, Jr. | 339/98 |
| 3,435,168 | 3/1969 | Cooney | 339/108 TP |
| 3,845,455 | 10/1974 | Shoemaker | 339/97 R |
| 3,937,549 | 2/1976 | Hughes | 339/276 T |
| 3,982,811 | 9/1976 | Siu et al. | 339/105 |
| 4,050,762 | 9/1977 | Hines et al. | 339/108 TP |

FOREIGN PATENT DOCUMENTS

| | | | |
|---|---|---|---|
| 647185 | 8/1964 | France | 339/276 T |

*Primary Examiner*—Joseph H. McGlynn
*Attorney, Agent, or Firm*—William W. Haefliger

[57] ABSTRACT

Method of electrically interconnecting terminals on a terminal board includes:

(a) providing multiple metallic terminals on the board, the terminals having slots with open mouths between terminal edges, (b) providing wiring with or without insulation thereon, and (c) forcibly displacing the wiring sidewardly into the slots via their mouths in such manner that insulation, if present, is sheared off the wiring by the terminal edges, and the wiring is locally deformed and stabilized in position as it enters the slots thereby to produce stabilized metal-to-metal contact between the wiring and terminal metal at the inner sides of the slots.

6 Claims, 13 Drawing Figures

WIRE CONNECTIONS TO BOARD TERMINALS

BACKGROUND OF THE INVENTION

This invention relates generally to the testing of electronics circuitry, and more particularly concerns wiring terminals adapted for use with spring probe assemblies associated with terminal boards. The invention provides all of the highly desired features of high density, low profile packaging, without the inherent high cost, extended delivery and reliability problems found with existing interconnection alternatives.

Such known interconnection alternatives include: (a) multi-layered boards characterized by plate-through holes in multilayers; (b) "wire-wrap" boards, wherein wires are forcibly wrapped several times about polygonal cross-section terminal pins; and (c) "stitch-weld" connections.

(a) The design/manufacturing cycle of multilayer boards is typically several weeks or months due to the sequential task in fabrication. Probably the biggest disadvantage of multilayers is the difficulty, cost and delay in effecting engineering change orders. External wiring is commonly used where wire termination provisions are practically nonexistent. Existing circuits are "erased" with a sharp knife and the result, in general, is nonacceptable. Another disadvantage is inconsistancy in fabrication. At best, the production of plated-through-holes in multilayers is a highly controlled process with the final reliability directly dependent on several different steps being successfully completed. Yield rates of 70% (30% have defects) is not uncommon on large, high density boards with 8 to 10 layers. This manufacturing problem is compounded by the fact that the defects are internal to the board and cannot be detected by means of visual inspection. As a result, the manufacturer or user has a choice of one of two very expensive alternatives:

i Use special electronic test equipment for prescreening the boards prior to adding value (components and labor)

ii Adding value and detecting the failures at board or system test.

Since the boards are nonrepairable, those with internal shorts or opens are usually discarded (with components), at great expense.

(b) In the production of wire wrap boards, it is necessary to remove the top (Z) level wires in order to delete or remove a wire on bottom level. Since the wire cannot be rewrapped, all wires must be replaced. As can be seen, a simple interconnect change can require removal and replacement of several wires. Also, wire wrap techniques require that the wire be cut and wrapped at each terminal. This creates a serially connected circuit with two wraps at each terminal in a circuit string; furthermore wire wrapped connections are not easily soldered. In addition if a pin is to be connected to an adjacent pin 0.100 inch away, a minimum wire length of $1\frac{1}{2}$ inches must be used. Due to the high profile of wire wrap boards, the wires are usually channeled between the pins in a prescribed pattern causing many parallel runs. Such construction limits its usage except at comparatively low frequencies.

(c) A large disadvantage with "stickweld" techniques is the requirement that stainless steel is required to effect a termination. Typically, a special nickel alloy wire is required, at cost many times greater than ordinary commercial grade wiring, such as copper or aluminum wire. Also, with stickweld, extreme care must be taken when applying the break-thru pressure of the wire insulation, as well as electrical pulse, and energy levels. The quality of the termination with stickweld is directly dependent on several variables. A weld schedule must be established with the proper watt-second setting of the power supply for each type of terminal used. The watt-second setting will vary according to the geometry of the terminal or the type stainless steel used in the terminal or wire size, insulation type and conductor material used. Watt-second settings range from 2 to 20 watt-seconds. Quality procedures must be established to detect blown welds, cracks, expulsion, inclusions, open welds, pitting, spitting, voids, etc., on all terminations.

SUMMARY OF THE INVENTION

It is a major object of the invention to provide simple method and apparatus overcoming the above disadvantages and problems. Basically, the method of electrically interconnecting terminals on a terminal board, in accordance with the invention, includes the following steps:

(a) providing multiple metallic terminals on the board, such terminals having slots with open mouths between terminal edges, (b) providing wiring with insulation thereon, and (c) forcibly displacing the wiring sidewardly into the slots via their mouths in such manner that the insulation is sheared off the wire by the terminal edges, and the wiring is locally deformed as it enters the slots thereby to produce metal-to-metal contact between the wiring and the terminal metal at the inner sides of the slots.

As will be seen, multiple wires may be easily stacked into an individual slot, so that replacement or removal of a wire merely requires shearing of the wire and introducing a new wire into the slot; the wiring is typically extruded as it enters the slot so as to flatly and firmly engage the slot walls to establish extensive and firm electrical contact; the terminals may be clamped as the wires are introduced into the slots, as well as capped after such introduction, to assure maintenance of the electrical contact; and the slot walls may be provided with edges or projections to penetrate the wiring as it enters the slot.

In its apparatus aspects, the invention is typically embodied in a terminal board that comprises:

(a) a terminal board, (b) multiple metallic terminals projecting from the board, (c) such terminals having slots extending generally axially therein from open terminal end mouths having edges, and (d) wiring forcibly displaced sidewardly past the edges and into the slots via said mouths, the axes of the wiring extending generally normal to the axes of the terminals, and opposite sides of the wiring having metal-to-metal contact with the inner walls of said terminals spaced at opposite sides of the slots, the wiring projecting through the slots and extending between different terminals.

Typically, the terminal may include a shank end to penetrate and make electrical contact with a sleeve associated with a spring probe assembly; a flange to engage the end of a tubular housing associated with the spring probe assembly; and a shoulder such as a taper to seat the spring in that assembly, all as will be seen.

Advantages realized by the invention include:

(a) Board fabrication is directly dependent upon the mechanical dimensions of a slotted terminal and wire diameter, both of which are exactly controlled in their manufacture. Terminations can be visually inspected and the board is easily repaired. Cost savings are especially pronounced with lower production quantities of boards, as compared with multi-layer boards referred to above.

(b) Slant or planar packaging density is considerably improved over prior methods. Due to the lower profile of wire terminals, it is possible to have two or three terminal boards in the same space as one wire wrap type board.

(c) Wiring changes are more easily made on boards as described. Since multiple wires can be stacked in a slot, wires or circuits can be deleted by simply snipping wires, and new circuits can be added with equal ease by staking new wires.

(d) Ordinary wire may be used, as compared with expensive stainless steel wire require for stickweld connections.

(e) Terminals are easily and economically soldered, if required, such that the mechanical connection and solder offer a comparable or better connection than the soldered component to which it interconnects.

Additional advantages include the provision of a technique, and apparatus, to effect local narrowing of the slots in the terminals in such manner as to block dislodgement of the inserted wiring toward the slot mouths. This also effects gripping and stabilizing of the wiring in the slots.

These and other objects and advantages of the invention as well as the details of illustrative embodiments, will be more fully understood from the following description and drawings in which:

DRAWING DESCRIPTION

DETAILED DESCRIPTION

Figure 1:
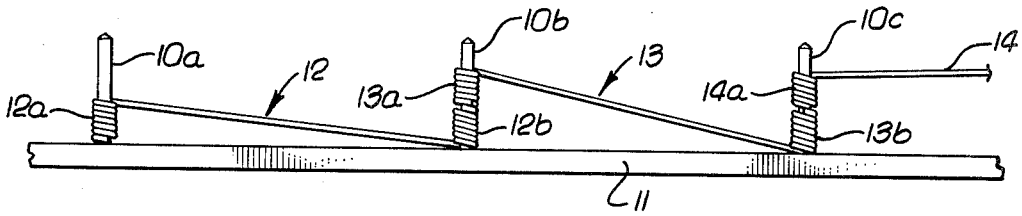
FIG. 1 is a side elevation showing prior wire wrapped terminals.

In FIG. 1 a known wire wrap configuration is illustrated, with terminal pins 10*a*–10*c* projecting from a board 11. A first wire 12 is wrapped about pin 10*a* at 12*a*, and then wrapped at 12*b* about pin 10*b*. A second wire 13 is wrapped at 13*a* about pin 10*b*, and is then wrapped at 13*b* about pin 10*c*. An additional wire 14 is wrapped at 14*a* about pin 10*c*. One disadvantage lies in the vertical lengths of each multi-turn wrap as at 12*a*, 12*b*, 13*a*, 13*b*, and 14*a*, about the pins. These lengths require undesired elongation of the pins, which increases the size of each circuit board assembly. Also, changing of wires is a complex task; for example, wrap 13*a* must be removed before wrap 12*b* can be removed; but since re-wrapping cannot be done, wire 13 and wrap 13*b* must then be removed, and so on.

The method of wire attachment to terminals as shown in FIGS. 2–4, 8 and 9 obviates these problems, in that the lengths of terminals can be minimized; and wires can be easily attached, deactivated as by severing and substitute wires added. Thus, as illustrated, a terminal board 16 typically carries multiple metallic terminals 17 each having a slot 18 extending axially inwardly from the terminal end. The slot mouth is typically defined between slot edges 18*a* at the inner sides of the terminal sections 17*a* at opposite sides of the slot.

Figure 4:
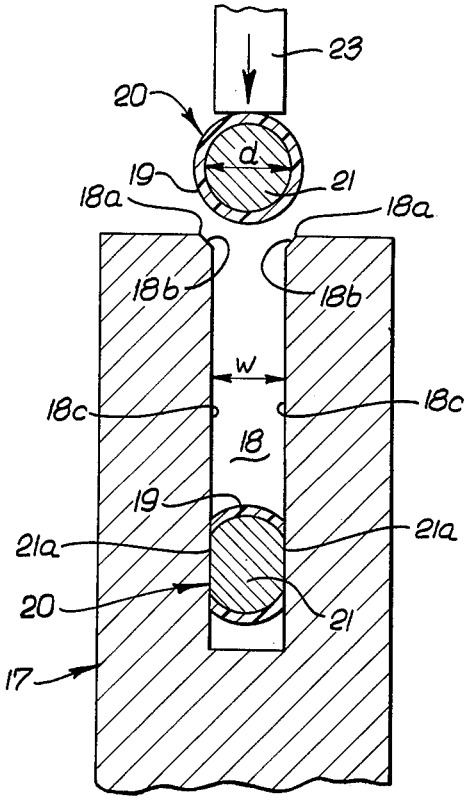
FIG. 4 is a side elevation on lines 4—4 of FIG. 3.

As shown in FIG. 4, edges 18*a* may be sufficiently sharp to peel off the insulation 19 on the wire 20 forced sidewardly into the slot, and the slot walls just below the edge may be tapered at 18*b* to extrude the wire metal 21 into the slot 18 which is of slightly smaller width "w" than the wire metal diameter "d". Accordingly, the wire sides become deformed as by flattening as at 21*a* to form extensive face-to-face electrical contact with the slot walls 18*c* below the tapered portions 18*b*. A pusher to urge the wire sidewardly into the slot is shown at 23. Note that the axis of each wire in the slot is approximately normal to the central axis of the terminal.

As will be understood, the wire may be staked or pressed fitted with either a hand tool (manual) or machine (semiautomatic). Typically, the wire is placed lengthwise across the slot and is forced to the slot's extremity. The slot width and wire size are selected such that the wedging operation strips the wire insulation and deforms the wire, thus causing an air tight mechanical bond between the wire and wire terminal. The wire can continue to the next point in the signal string or can be cut or sheared at the circuit end point. As can be seen, wires can be stacked one on top of another and terminals are easily soldered, if required, for an electrical bond that either meets or exceeds that of the soldered components to which it interconnects.

Figure 8:
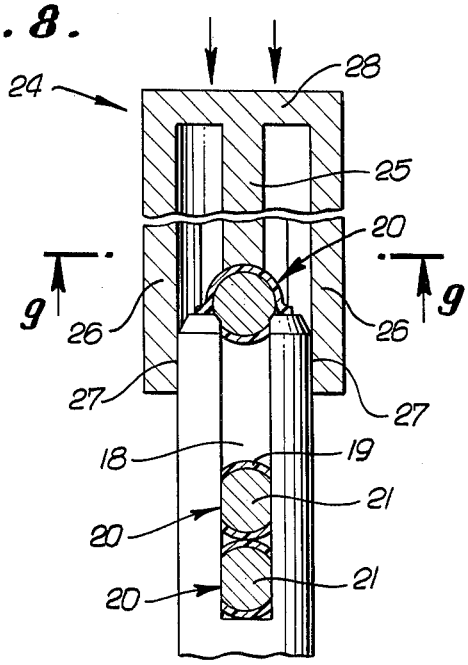
FIG. 8 is a vertical section showing clamping of the terminal post as the wire is inserted.
Figure 9:
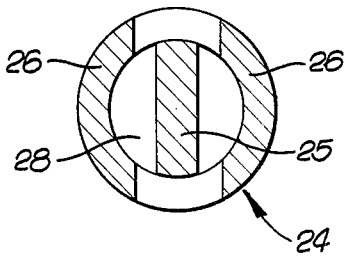
FIG. 9 is a section on lines 9—9 of FIG. 8.
Figure 3:
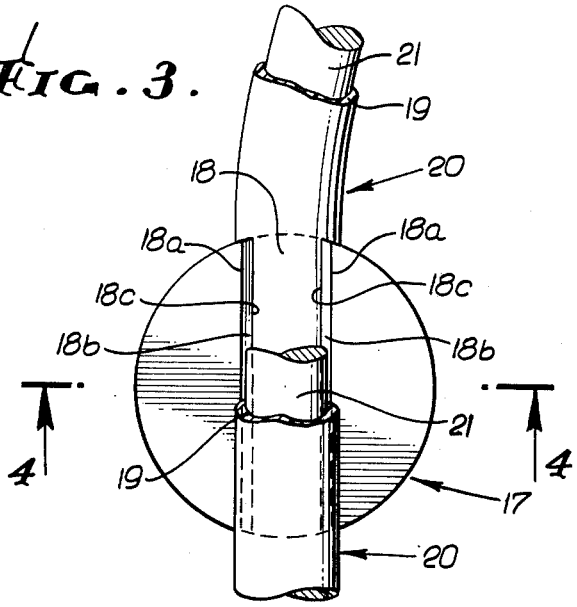
FIG. 3 is an enlarged end view of a slotted terminal to which wires are being wedge connected.

FIGS. 8 and 9 illustrate a pusher 24 that guides on the terminal exterior during pushing deformation of the wire into the slot. For this purpose, the pusher may include a tongue 25 that projects over the wire to enter the slot, and a cap with legs 26 that guide at 27 on the terminal exterior. Legs 26 depend from the cap crosspiece 28 which carries the tongue 25. The legs 26 also serve to clamp the terminal section 17*a*, preventing enlargement of the slot as the wire is forced into it.

Figure 2:
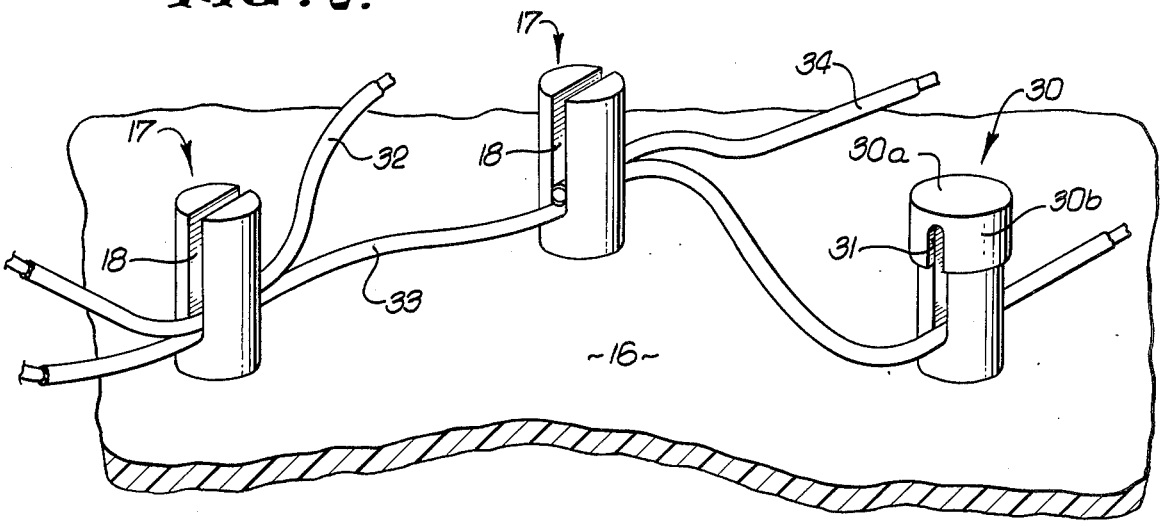
FIG. 2 is a perspective showing wedge connection of wiring to terminals, in accordance with the invention.

FIG. 8 also illustrates multiple wires 20 stacked sidwardly into a slot 18 in a terminal. It is clear from FIGS. 2 and 8 that any of the wires may be severed, and that a replacement or substitute may be introduced into the top of the slot, without requiring removal of that portion of the deactivated wire that remains in the lower portion of the slot. FIG. 2 also illustrates the provision of a cap 30 for the terminal, the cap having a top 30*a* and a cylindrical skirt 30*b* with slots 31 in registration with terminal slot 18. The cap also exerts force preventing enlargement of the slot 18. Note wires 32–34 in FIG. 2, and their connection to the terminals, via the slots therein.

Figure 5:
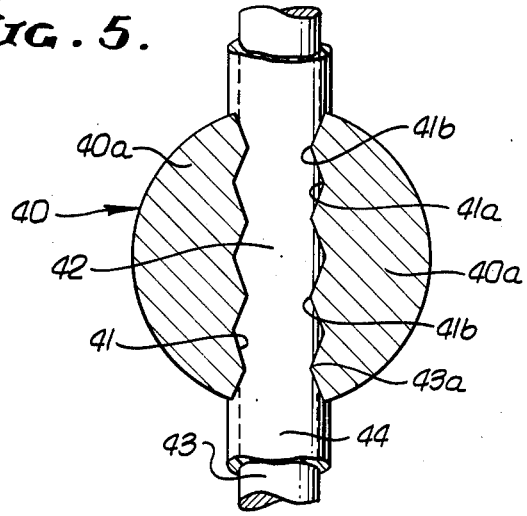
FIG. 5 is an end view of a modified slotted terminal.

Referring to FIG. 5, the modified terminal 40 includes a pair of terminal sections 40*a* separated by an axial slot 41. The slot walls 41*a* define sharp edges 41*b* which protrude into the slot, and extend axially endwise into the slot, in the direction of the terminal axis 42. For this purpose, the slot walls may extend in Zig-Zag pattern, as shown, although other patterns may be utilized. The electrically conductive wire 43 extruded into the slot, in the manner as disclosed above, has metallic side faces 43*a* which are penetrated by the edges 41*b*, as shown, at multiple locations to make positive electrical contact with the wiring. As a result, the benefits of wire-wrap post corner penetration of the wiring are achieved, or exceeded, without the disadvantages of such posts, as described above. Wire insulation is shown at 44, and is sheared off at the mouth of the slot or recess, as described above.

Figure 6:
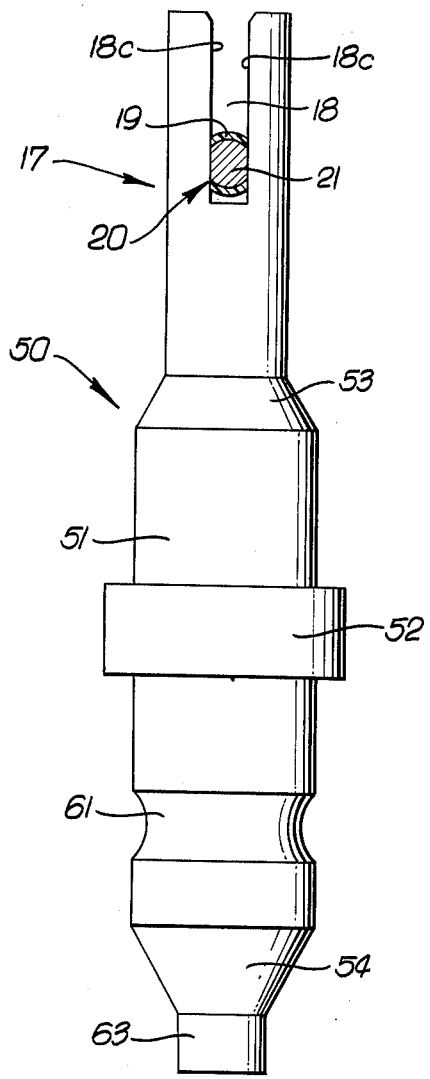
FIG. 6 is an elevation showing a complete terminal embodying the invention.
Figure 7:
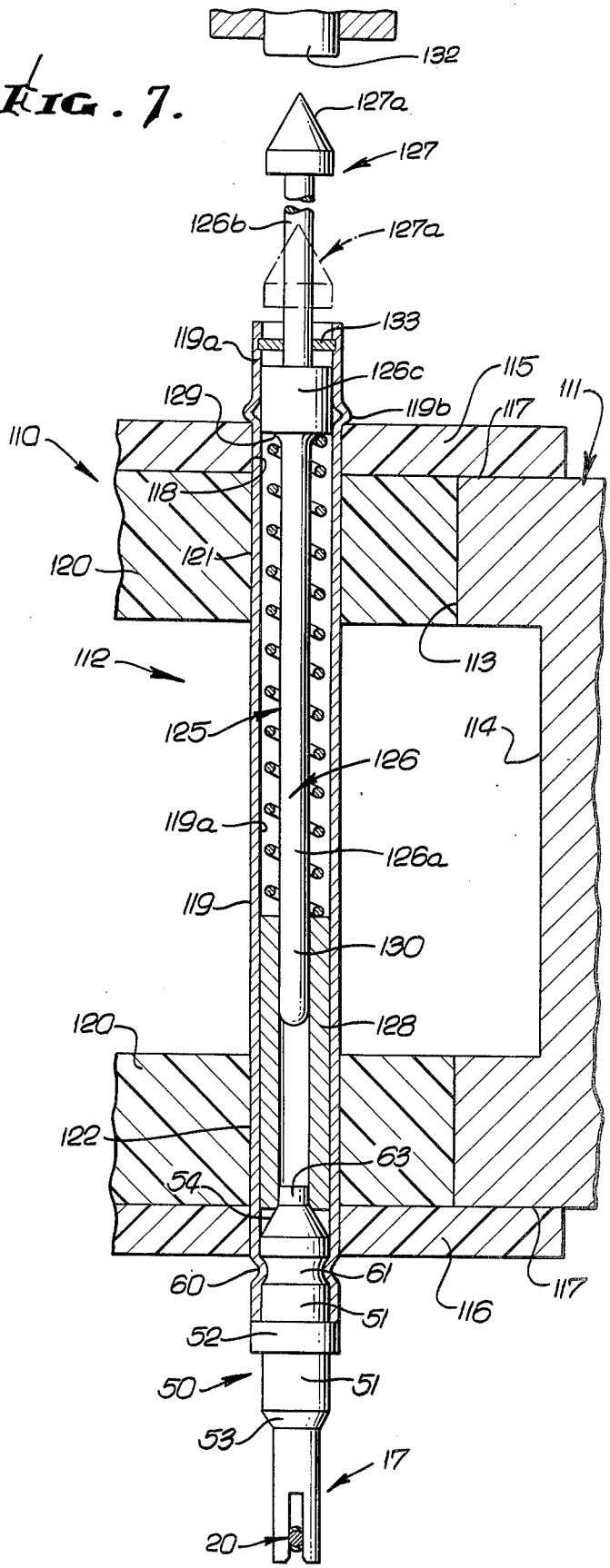
FIG. 7 is a section through an insulation board embodying terminals in accordance with the invention.

FIG. 6 shows a complete terminal 50 with end extent 17 as described above. The terminal includes an enlarged cylindrical shank 51 having a cylindrical flange 52 thereon between taper 53 and taper 54. Extending the description to FIG. 7, the terminal is especially constructed for use in combination with insulator boards as described in my companion application entitled, "A Repairable Spring Probe Assembly". As there described, an insulator board 110 includes a frame 111 which may be rectangular, and which defines a central, typically rectangular, opening 112. In this regard, the frame inner periphery 113 may be recessed as at 114, the recess extending about the opening 112. The board also includes upper and lower horizontal plates 115 and 116 which are vertically spaced apart. Such plates may be suitably attached to the upper and lower flat sides of the frame, as at 117. The plates may be electrically insulative.

Openings or bores 118 are drilled or formed in the plates to receive vertically extending tubular housings 119, which are in turn adapted to receive spring probe assemblies. The housings may for example hve press fit attachment to the plates, at bores 118. In addition, the housings preferably are secured in position by insulative material 120 located between the plates and bonded to intermediate portions of the housings, as at locations 121 and 122. Material 120 may advantageously consist of synthetic resin such as epoxy resin formed in vertically spaced layers as shown.

The barrel or housing 119 typically protrudes at 119*a* above the upper plate. Further, an expanded ring portion 119*b* of the barrel engages the top of the plate 115 to limit downward initial insertion or reception of the barrel 119 into the plates 115 and 116.

The spring probe assembly or sub-assembly 125 includes a vertically elongated plunger 126 characterized by a vertically and axially elongated lower section 126*a*, and a vertically and axially elongated upper section 126*b*. The latter is substantially shorter than the former, and separated therefrom by a cylindrical enlargement 126*c* integral with the plunger. The enlargement is sized to wipe-contact the bore 119*a* of the tubular housing, affording an electrical contact path between the plunger and enclosure as the plunger moves up and down in the enclosure. A contact head 127 is integral with the plunger at its upper end, and includes a tapered end portion 127*a* adapted to engage an electrical contact to be tested. The head, plunger and enlargement may all consist of electrically conductive material such as aluminum, copper, etc. Sections 126*a* and 126*b* are of reduced diameter in order to avoid rubbing contact with bore 119*a*, thereby reducing frictional resistance to movement of the plunger.

A vertically elongated guide sleeve 128 receives the lowermost portion of the plunger, to have wipe-contact therewith, and a compression spring 129 is received on plunger portion 126*a* to tend to urge the plunger and sleeve in relatively opposite directions. In this regard, the spring and sleeve may also consist of electrically conductive material to provide additional electrical paths between the plunger and enclosure 119. The upper end of the spring typically engages the lower portion of the enlargement, i.e. at 129, and the lower end of the sleeve typically engages the taper 54 on the terminal 50, which acts as a stop. The sleeve also has close sliding fit, i.e. electrical contact with the enclosure bore 119*a*. Spring 129 serves to urge the probe plunger toward up-position as seen in solid lines in FIG. 7. A contact is shown at 132 to be relatively displaced toward the head, urging it downwardly toward lower position indicated by broken lines 127′.

The probe sub-assembly 125 is easily removed from the housing 119, for replacement or repair, after simple removal of means 133 from the housing. That means 133 may advantageously comprise a C-ring tightly fitting the bore 119*a* of the housing. Ring 133 has loose sliding fit with plunger upper section 126*b*. If desired, a small annular recess may be formed in bore 119*a* to receive the outermost portion of the ring. The ring is easily removed from the bore as by a tool interfitting small openings in the ring ends, whereby the ring may be radially inwardly deflected to disengage bore 119*a*.

The terminal 50 at the lower end of the housing 119 is received upwardly therein and attached thereto as by crimping the housing annular extent into the annular recess 61 on the terminal shank. Note that the flange 52 seats against the lowermost end of the housing 119. Also, the upper end 63 of terminal 50 fits into and has electrical contact with sleeve 128. Accordingly, two electrical paths to the terminal 50 are provided, i.e. via sleeve 128 to end 63, and via housing 119 to shank 51.

The mechanics of fabricating a wire wedge board are relatively simple and straight forward. A universal printed wiring board artwork is made which typically has only ground and power conductors on the respective sides of the board. The boards are manufactured and holes are drilled in a predetermined pattern. The appropriate slotted wire terminal pins are selectively press-fit into these holes. The power and ground planes are etched away such that these pins are electrically insolated. The boards are now ready for the unique signal wiring.

Commercial grade AWG-30 or AWG-28 teflon coated wire is continuously fed through an eyelet to the wire wedge terminator point. When a connection is desired, the terminator point is pneumatically lowered to the desired pin. A spring loaded plunger is used to apply a small dynamic force to wedge the wire in the slot. The terminator point mechanism uses the wire eyelet to align the slot with the staking pin. On a termination completion, the terminator point is then positioned consecutively to all the other common points in a given signal string. The wire wedging process eliminates all need of stripping and cutting wires to prescribed lengths. Wires may be stacked to any desired slot depth and are easily removed and reinstated with or without solder.

Figure 10:
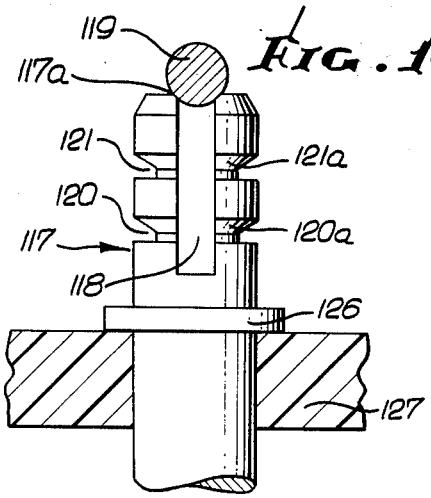
FIG. 10 is an elevation showing a modified terminal.

Referring to FIG. 10, a modified terminal is shown at 117, with a wire 119 extending cross wise of the terminal at its mouth 117*a*, and in position to be forced into the slot 118 in the manner described above. The terminal is locally weakened at its opposite sides, at predetermined locations, as for example is indicated by semi-circular grooves 120 and 121 extending about the terminal and also about the slot. Other forms of local weakening may be employed, the terminal walls thereby being typically narrowed in thickness, as at 120*a* and 121*a*.

Figure 11:
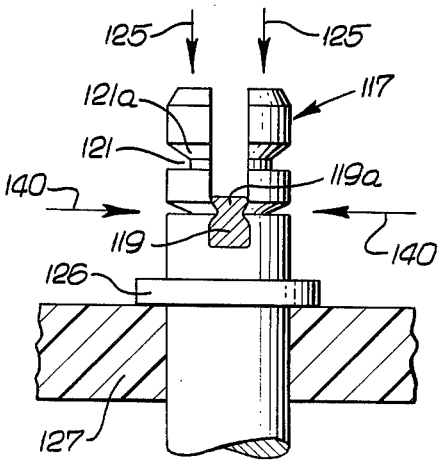
FIG. 11 is a view like FIG. 10, showing the terminal after slot narrowing.

After the wire has been forcibly displaced into the groove to a depth below the level of groove 120, the walls at locations 120*a* are narrowed so as to grip and possibly deform the softer wire, as seen in FIG. 11 at 119*a*. As a result, the wire is staked or gripped to an extent blocking its dislodgement toward the slot mouth and generally stabilizing the wire in position, as shown. Such narrowing is typically effected as by endwise partially collapsing or foreshortening of the terminal, as by impact or other force application to the top end of the terminal. See force arrows 125. The collapse of the upper groove may be prevented in the manner described below; subsequently, it may be collapsed to stake an upper wire. To complete the description, the terminal includes a flange 126 seating on terminal board 127.

Figure 12:
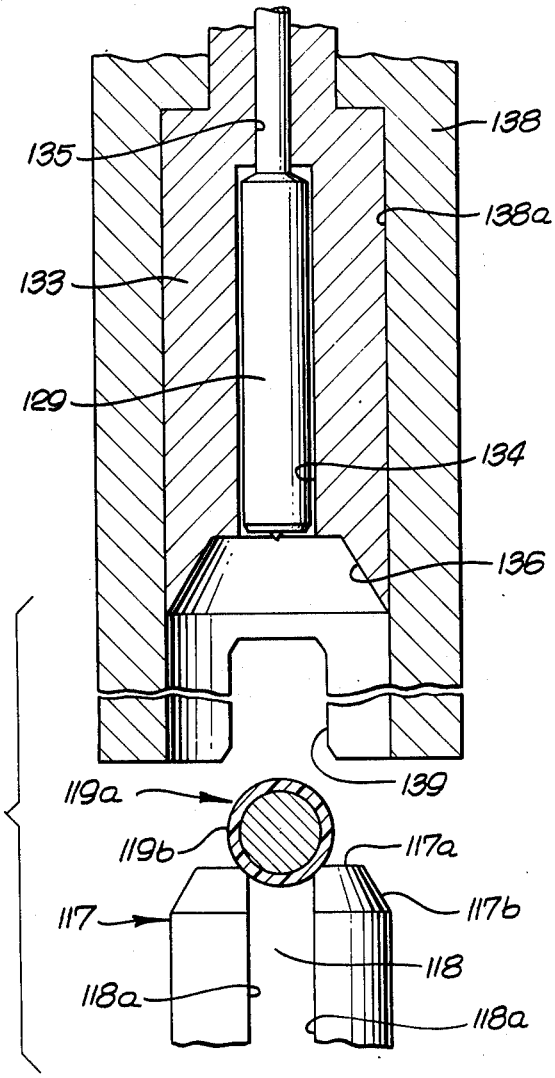
FIG. 12 is an elevation showing tooling to effect slot narrowing.

FIG. 12 depicts tooling for the purpose described above. A pusher 129 extends directly above the wiring 119*a*, and is sized to enter the slot to drive the wire to predetermined level in the slot, as for example the level shown in FIG. 13, just below the level of semi-circular recesses or grooves 120*a*. Insulation 119*b* may be stripped off the wire as by slot mouth edges 130 as the wire enters the slot. Note that the wire may be deformed to have flat sides at 119*c* forcibly engaging the flat side walls 118*a* of the slot, the latter stabilizing the wire in its laterally extended position.

Means is provided to exert force against the upper end 117*a* of the terminal 117, to collapse the terminal to predetermined extent, thereby to effect selective and local narrowing of the slot just below wire level and subsequent narrowing of another slot just below the level of another inserted wire. Such means is shown to comprise a crimping sleeve 133 extending coaxially with terminal 117 and pusher 129. The latter extends within bores 134 and 135 in the sleeve, for relative displacement. The sleeve has a tapered lower end 136 to engage with or impact against the tapered upper end 117*b* of the terminal.

Figure 13:
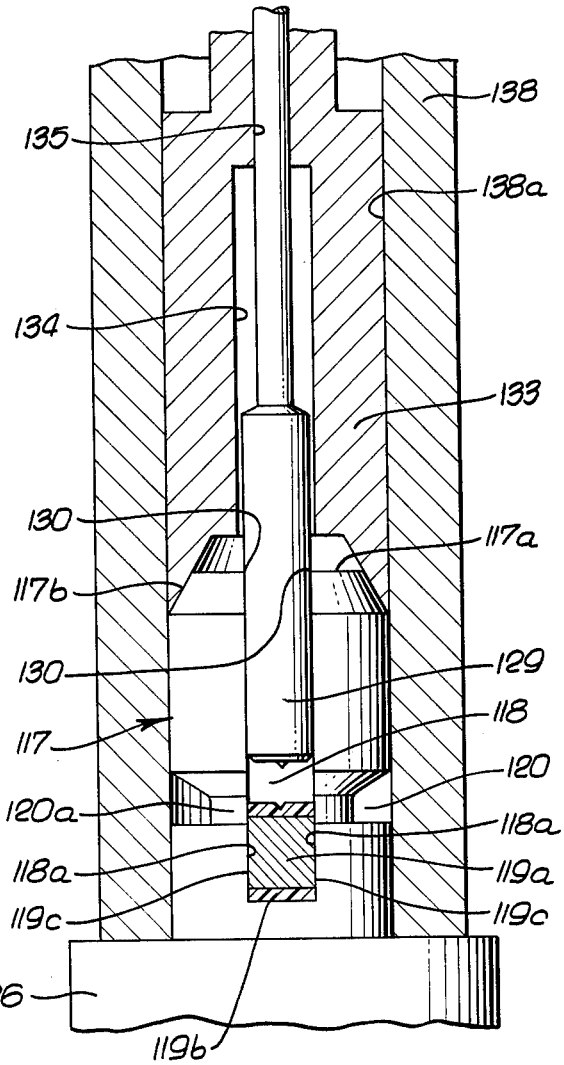
FIG. 13 is an elevation showing the FIG. 12 tooling applied to a terminal.

Also, the sleeve is downwardly movable in a bore 138*a* in a housing structure 138 that is downwardly closely receivable over the terminal. Side slots 139 in the housing structure register with slot 118, to allow passage of the wire through the structure 138. Once the latter is in position about the terminal, pusher 129 is lowered to insert the wire into the slot, to selected position just below the level of groove 120*a*. Thereafter, the pusher is upwardly retracted to position just above that groove, as shown in FIG. 13. Thereafter, the sleeve 133 is lowered to impact the terminal, and effect collapse of the latter, as shown in FIG. 11. Sideward "crimping" forces are indicated by arrows at 140 in FIG. 11. During such local narrowing of slot 118, the pusher blocks slot narrowing above the level of the crimp zone, whereby an upper groove as at 121 in FIG. 11 may be subsequently collapsed about a subsequently inserted wire. Also, the housing structure 138 extending closely about the terminal prevents expansion thereof during terminal collapsing steps.

The wire connections to terminals as described above are especially adapted to "flow soldering" techniques, wherein the board is inverted, and melted solder is caused to flow against the downwardly projecting terminals and the wire stabilized therein. Also, solder may be melted out, and wires removed, as desired.

I claim:

1. In combination with a tubular housing for use on an insulator board, a spring probe assembly comprising (a) a vertically and axially elongated plunger and a contact head at one end of the plunger, (b) an enlargement on the plunger to slidably fit a bore defined by the tubular housing, (c) retention means within the tubular housing to releasably retain the plunger and enlargement axially within the housing the, housing having a bore free of shoulders that would block axial withdrawal of the plunger and enlargement from the housing upon release of said means, (d) a compression spring on the plunger and located between said enlargement and said sleeve to yieldably urge said plunger in a direction toward said head, and (e) a terminal at the end of said tubular housing opposite said contact head, said terminal telescopically attached to said tubular housing, and said terminal being axially slotted to sidewardly receive a wire or multiple wires.

2. The combination of claim 1 including said insulator board receiving said housing.

3. The combination of claim 1 wherein the terminal has a flange engaging the end of said tubular housing, said terminal having an annular recess within the tubular housing and to which the housing is crimped.

4. The combination of claim 1 wherein the terminal has a shank penetrating said housing, said shank seating said spring and received into said sleeve.

5. The combination of claim 1 wherein the slotted terminal has parallel cutting edges which are transversely spaced and which extend completely across the terminal, at the end thereof, the terminal having laterally spaced walls that intersect said edges and taper away from said edges to extrude wire metal into an axially elongated slot formed by the terminal, said walls also extending completely across the terminal.

6. The combination of claim 5 including a cylindrical bore receiving the opposite end of the plunger and spaced from said enlargement, and aligned with the enlargement and with said terminal.

* * * * *